US009709236B2

(12) United States Patent
Kato

(10) Patent No.: US 9,709,236 B2
(45) Date of Patent: Jul. 18, 2017

(54) VEHICLE LAMP AND METHOD OF MANUFACTURING THE SAME

(71) Applicant: KOITO MANUFACTURING CO., LTD., Tokyo (JP)

(72) Inventor: Shingo Kato, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 206 days.

(21) Appl. No.: 14/507,341

(22) Filed: Oct. 6, 2014

(65) Prior Publication Data

US 2015/0103545 A1 Apr. 16, 2015

(30) Foreign Application Priority Data

Oct. 11, 2013 (JP) ..... 2013-213443
May 29, 2014 (JP) ..... 2014-111277

(51) Int. Cl.

| | |
|---|---|
| ***F21V 1/00*** | (2006.01) |
| ***F21S 8/10*** | (2006.01) |
| ***B22D 25/02*** | (2006.01) |
| ***B22D 19/00*** | (2006.01) |
| *F21Y 115/10* | (2016.01) |

(52) U.S. Cl.

CPC ..... *F21S 48/14* (2013.01); *B22D 19/00* (2013.01); *B22D 25/02* (2013.01); *F21S 48/1104* (2013.01); *F21S 48/1109* (2013.01); *F21S 48/1154* (2013.01); *F21S 48/1159* (2013.01); *F21S 48/125* (2013.01); *F21S 48/1216* (2013.01); *F21S 48/1258* (2013.01); *F21S 48/1305* (2013.01); *F21S 48/137* (2013.01); *F21S 48/1323* (2013.01); *F21S 48/145* (2013.01); *F21S 48/1763* (2013.01); *F21S 48/32* (2013.01); *F21S 48/328* (2013.01); *F21Y 2115/10* (2016.08)

(58) Field of Classification Search

CPC .... F21S 48/145; F21S 48/1784; F21S 48/115; F21S 48/14; B60Q 1/02; B60Q 1/04
USPC ..... 362/509, 523
See application file for complete search history.

(56) References Cited

U.S. PATENT DOCUMENTS

2004/0202007 A1 10/2004 Yagi et al.
2006/0285322 A1* 12/2006 Hasei ..... G02B 5/0215 362/225
2008/0239745 A1* 10/2008 Naganawa ..... F21S 48/1159 362/516

(Continued)

FOREIGN PATENT DOCUMENTS

CN 1536264 A 10/2004
JP 2007-294202 A 11/2007

OTHER PUBLICATIONS

Wikipedia:Injection Moulding, Jul. 4, 2013, as found on waybackmachine.*

(Continued)

*Primary Examiner* — Andrew Coughlin
*Assistant Examiner* — Matthew Peerce
(74) *Attorney, Agent, or Firm* — Sughrue Mion, PLLC

(57) ABSTRACT

A vehicle lamp includes a light source including a semiconductor light emitting device, and a metal support member on which the light source is mounted. The support member is integrally formed with a shade portion configured to block a portion of light emitted from the semiconductor light emitting device.

8 Claims, 13 Drawing Sheets

(56) References Cited

U.S. PATENT DOCUMENTS

2008/0310042 A1* 12/2008 Suzuki ..... C23C 28/00
359/883
2011/0127912 A1* 6/2011 Lee ..... F21S 48/1159
315/32

OTHER PUBLICATIONS

Communication dated Jun. 27, 2016, from the State Intellectual Property Office of People's Republic of China in counterpart Application No. 201410531785.5.

* cited by examiner

VEHICLE LAMP AND METHOD OF MANUFACTURING THE SAME

CROSS-REFERENCE TO RELATED APPLICATION

The present application claims priorities from Japanese Patent Application No. 2013-213443 filed on Oct. 11, 2013 and Japanese Patent Application No. 2014-111277 filed on May 29, 2014, the entire content of which is incorporated herein by reference.

BACKGROUND OF INVENTION

Field of Invention

The present disclosure relates to a vehicle lamp, and a method of manufacturing the vehicle lamp.

Related Art

Vehicle lamps that can form a low beam light distribution pattern are known, such as from Patent Document 1 (JP-A-2007-294202). A low beam light distribution pattern is a light distribution pattern that does not illuminate light above a cut-off line extending in a substantially horizontal direction and that is employed when passing other vehicles.

Such vehicle lamps form a light distribution pattern that does not illuminate light above the cut-off line, by blocking a portion of the light emitted from a light source using a shade member with a shape corresponding to the cut-off line of the low beam light distribution pattern.

A high level of shape precision is required for the cut-off line of the low beam light distribution pattern. Precision of the shape corresponding to the cut-off line is thereby generally secured by manufacturing the shade member using resin molding.

A semiconductor light source employing a semiconductor device such as a Light Emitting Diode (LED) is generally employed as a light source in a vehicle lamp. Recently, the output per two, or per one, semiconductor light emitting device(s) is increasing. For example, whereas previously, three semiconductor light sources were installed in a lamp unit to obtain the necessary brightness, in the future it is expected that it will be possible to secure sufficient brightness by installing two or one semiconductor light sources in the lamp unit. Vehicle lamp units are therefore being proposed that can obtain a high light intensity while reducing the number of semiconductor light sources installed to a single lamp unit, for a compact configuration.

Since lamp units giving good visibility can be obtained by installing semiconductor light sources that can emit a large amount of light, there is a demand for vehicle lamps installed with high output semiconductor light sources. However, there is a possibility of a resin shade member disposed near the semiconductor light source being deformed by heat, and a possibility of reducing shape precision of a light-dark boundary line, such as the cut-off line, as the light emission intensity of the semiconductor light source increases.

SUMMARY OF INVENTION

Exemplary embodiments of the invention provide a vehicle lamp and a manufacturing method of the vehicle lamp in which the shape precision of a light-dark boundary line is not liable to be reduced, even when semiconductor light sources that emit a large amount of light are installed.

A vehicle lamp according to an exemplary embodiment comprises:

a light source including a semiconductor light emitting device; and a metal support member on which the light source is mounted, wherein the support member is integrally formed with a shade portion configured to block a portion of light emitted from the semiconductor light emitting device.

In the vehicle lamp according to the exemplary embodiment of the invention, the shade portion is integrally formed to the metal support member. Even when light emitted from the semiconductor light source is absorbed by the shade portion and generates heat, the heat is quickly transmitted to portions of the support member other than the shade portion, and the shade portion is not liable to become hot. Since deformation of the shade portion due to heat can be suppressed, shape precision of the light-dark boundary line formed by projecting the shape of the shade portion is not liable to be reduced. Note that "blocks a portion of light" refers to blocking the direct progress of light heading toward the shade portion, and the direct progress of light may be blocked by the shade portion absorbing the light, or the direct progress of light may be blocked by the shade portion reflecting the light.

The shade portion may include a metal portion contiguous to the support member, an undercoat layer formed on the metal portion, and a metal film formed on the undercoat layer.

In the vehicle lamp according to the exemplary embodiment of the invention, the light-dark boundary line can be formed with high shape precision since the metal film is formed to the metal portion contiguous to the support member with the undercoat layer interposed between the metal film and the metal portion. Since the surface of the shade portion is made smooth by providing the undercoat layer, scattering by the shade portion is prevented, and optical use of the reflected light is facilitated. The utilization efficiency of the light increases and occurrence of glare can be effectively prevented.

The shade portion may extend in a direction intersecting with an optical axis of the vehicle lamp, and a ridge line, formed from an upward-facing upper face portion of the metal portion of the shade portion to a front-facing front face portion of the metal portion, may be formed in a rounded shape with a radius of curvature of from 0.1 mm to 1.0 mm in a cross-section orthogonal to the shade portion extension direction.

In the vehicle lamp according to the exemplary embodiment of the invention, there is high shape precision, since the metal portion of the shade portion can be easily manufactured using a manufacturing method in which burr does not occur.

The undercoat layer may be an ultraviolet curable resin including a photopolymerization initiator.

In the vehicle lamp according to the exemplary embodiment of the invention, the undercoat layer can be formed in a desired shape prior to the resin dripping, since the ultraviolet curable resin forming the undercoat layer cures straight away when illuminated with ultraviolet light. A shade portion capable of forming a light-dark boundary line can therefore be formed with high shape precision.

The shade portion may include:

a first horizontal portion;

a second horizontal portion positioned below the first horizontal portion; and an inclined portion which connects together the first horizontal portion and the second horizontal portion, and an upper portion of the metal portion forming a connecting portion between the inclined portion and the second horizontal portion may include a recessed portion indented downward.

In the vehicle lamp according to the exemplary embodiment of the invention, by including the recessed portion at the connecting portion between the inclined portion and the second horizontal portion, where the resin forming the undercoat layer is liable to pool, resin that has dripped down is accommodated in the recessed portion, and a light-dark boundary line can be formed with high shape precision.

A mold mark may be formed to the support member at the periphery of the shade portion.

In the vehicle lamp according to the exemplary embodiment of the invention, the support member is manufactured by combining together a mold to form the shape of the shade portion, and a mold to form the shape of the support member other than the shade portion. Namely, plural types of vehicle lamps that differ only in the shape of the shade portion can be provided at low cost. When combining together molds to form a support member in this way, a mold mark, corresponding to the boundary between molds, is formed to the support member at the periphery of the shade portion.

A method of manufacturing the metal support member of the vehicle lamp according to an exemplary embodiment, comprises:

preparing a plurality of molds so as to form a cavity forming the shape of the support member; and introducing metal into the cavity and solidifying the metal, and removing shade portion integrally formed to the support member, wherein the plurality of molds are disposed such that at a parting line of the molds is not positioned at the shade portion.

In the manufacturing method according to the exemplary embodiment of the invention, burr removal work is not required, since burr does not occur at the shade portion.

The molds may include a round shaped portion with a radius of curvature of from 0.1 mm to 1.0 mm, and the shape of the round shaped portion may be transferred to form the shade portion.

In the manufacturing method according to the invention, occurrence of burr at the shade portion can be prevented, and variation in shape precision is not liable to occur.

The vehicle lamp according to the exemplary embodiments of the invention provides a vehicle lamp and a manufacturing method of the vehicle lamp in which the shape precision of a light-dark boundary line is not liable to be reduced, even when semiconductor light sources that emit a large amount of light are installed.

DETAILED DESCRIPTION

First Embodiment

Detailed explanation follows regarding a vehicle lamp according to an embodiment of the invention, with reference to FIG. 1 to FIG. 3B.

Overall Configuration

Figure 1:
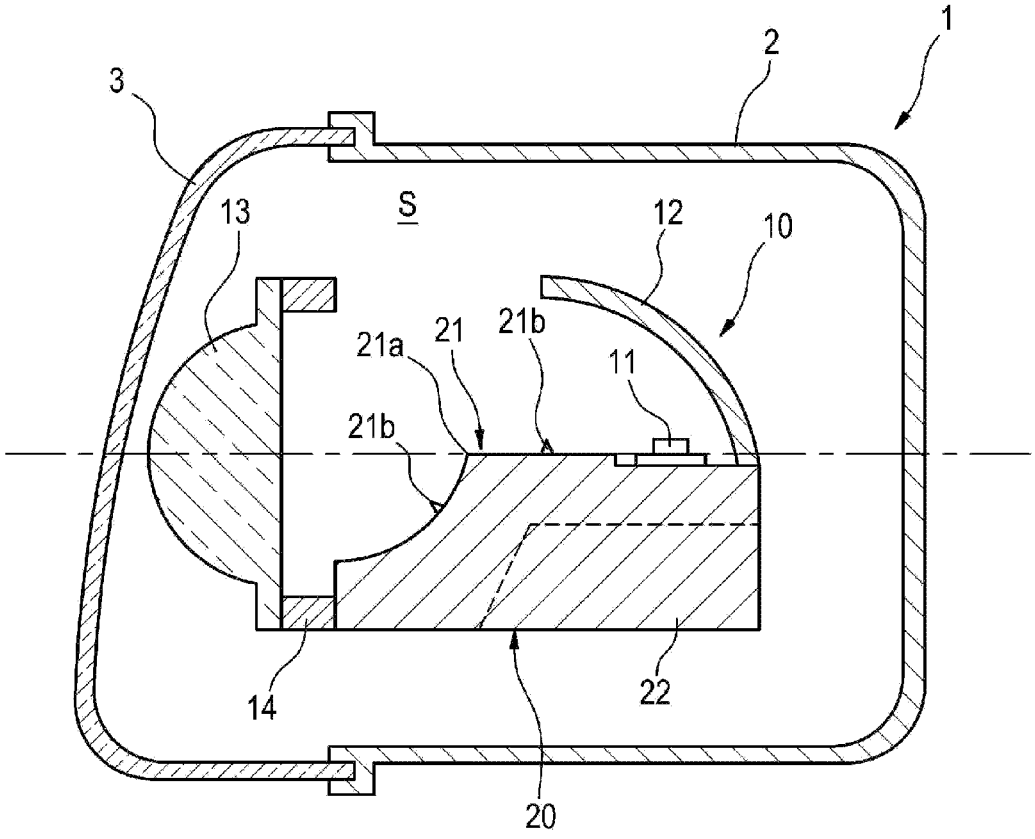
FIG. 1 is a cross-section view of a vehicle lamp according to a first embodiment of the invention.

A vehicle lamp 1 according to the embodiment is a vehicle lamp which can illuminate a low beam light distribution pattern that is illuminated when passing other vehicles. FIG. 1 is a cross-section view of the vehicle lamp according to a first embodiment of the invention.

As illustrated in FIG. 1, the vehicle lamp 1 includes a housing 2 open at the front, and an outer lens 3 formed of a transparent resin. The outer lens 3 is attached to the housing 2 so as to cover the opening of the housing 2, and a lamp chamber S is formed therein. A lamp unit 10 is provided inside the lamp chamber S.

The lamp unit 10 includes a semiconductor light source 11 provided with a Light Emitting Diode (LED) device that is an example of a semiconductor light emitting device, a reflector 12, a projection lens 13, and a support member 20.

The support member 20 is a substantially rectangular shaped metal member. The semiconductor light source 11 and the reflector 12 are attached to an upper face of the support member 20. A lens support member 14, to which the projection lens 13 is fixed, is attached to a front face of the support member 20. A fin 22, functioning as a heat sink, is provided at a lower portion of the support member 20. The fin 22 is integrally formed to the support member 20 using the same material as the support member 20.

A shade portion 21 is integrally provided to the support member 20 at the upper face of the support member 20, between the semiconductor light source 11 and the projection lens 13. The shade portion 21 blocks a portion of the direct light emitted from the semiconductor light source 11, and a portion of the reflected light emitted from the semiconductor light source 11 and reflected by the reflector 12.

The semiconductor light emitting device of the semiconductor light source 11 is orientated with the light emitting face thereof facing upward, and is installed to the upper face of the support member 20, with a circuit board interposed therebetween. Note that a Laser Diode (LD) device, or an Electro Luminescence (EL) device, etc., may be employed as the semiconductor light emitting device instead of an LED device.

The reflector 12 is attached to the upper face of the support member 20, behind the semiconductor light source 11. A reflective face is formed in a substantially ellipsoid of revolution shape at an inner peripheral face of the reflector 12. The semiconductor light source 11 is disposed at, or in the vicinity of, a first focal point of the ellipsoid of revolution of the reflector 12, and a ridge line 21*a* of the shade portion 21 is disposed at, or in the vicinity of, the second focal point of the ellipsoid of revolution of the reflector 12.

The projection lens 13 is a plano-convex lens, with a convex curved front face, and a flat rear face. A rear side focal point of the projection lens 13 is positioned at or in the vicinity of the ridge line 21*a* of the shade portion 21.

A portion of the light emitted from the semiconductor light source 11 is reflected by the reflector 12 and focused in the vicinity of the ridge line 21*a* of the shade portion 21. The light focused in the vicinity of the ridge line 21*a* of the shade portion 21 is illuminated forward from the lamp, while being up-down and left-right inverted by the projection lens 13. A portion of the light is blocked at this stage by the shade portion 21, thereby forming a dark portion, arising from the shade portion 21, in the light distribution pattern formed in front of the lamp by the lamp unit 10.

Figure 2:
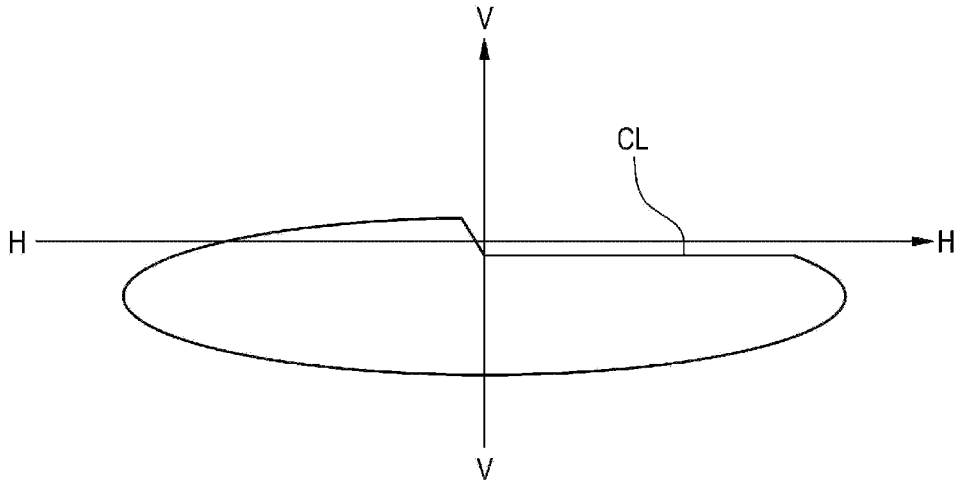
FIG. 2 is a view illustrating a low beam light distribution pattern formed by the vehicle lamp.

FIG. 2 illustrates a light distribution pattern formed by the vehicle lamp 1 projected on a virtual screen provided 25 m in front of the lamp. As illustrated in FIG. 2, the vehicle lamp 1 according to the embodiment forms a low beam light distribution pattern including a cut-off line CL at an upper edge. The cut-off line CL has a shape corresponding to the shape of the ridge line 21*a* of the shade portion 21.

Advantageous Effects

Since the shade portion 21 is positioned in the vicinity of the second focal point of the ellipsoid of revolution shaped reflector 12, reflected light from the reflector 12 is focused on the shade portion 21 and then the shade portion 21 absorbs the energy of the focused reflected light and is liable to become hot. Deformation of the shade portion 21 at high temperature distorts the shape of the cut-off line CL, formed by projecting the shape of the shade portion 21, and reduce the shape precision. In the event that the shade portion 21 was to deform, a projection-recess formed in the ridge line due to the deformation, for example, would result in a recess-projection in the cut-off line CL in FIG. 2. Such an issue is particularly evident in cases in which a high output LED device is employed. This issue becomes even more evident in a vehicle lamp configuring a light distribution pattern using a single semiconductor light source since a high output LED device is installed.

In the vehicle lamp 1 according to the embodiment, however, the shade portion 21 is integrally formed (monolithic) to the metal support member 20. Heat arising in the shade portion 21 is thereby easily transmitted to other portions of the support member 20, suppressing the shade portion 21 from becoming hot. The shade portion 21 is therefore not liable to deform, even when a semiconductor light source 11 that can emit a large amount of light is installed, such that the shape precision of the light-dark boundary line is not liable to decrease. Moreover, since the shade portion 21 itself is formed of the same metal as the support member, it is not liable to deform, even when hot.

Since the shade portion 21 and the support member 20 are an integral body, there is no assembly error in contrast to cases in which, as is related-art, a shade member and a support member are formed separately, then assembled to each other. The embodiment therefore provides a vehicle lamp 1 that can form a cut-off line CL with high shape precision.

Since the shade portion 21 is formed of the same metal as the support member 20, heat resistance is higher than in cases in which a shade member is formed of resin, as is related-art. Damage caused to the shade portion 21 due to sunlight focused in the vicinity of the shade portion 21 by the projection lens 13, referred to as melt damage, can therefore be avoided.

In the vehicle lamp 1 according to the embodiment, the fin 22 functioning as a heat sink is integrally formed to the support member 20. Heat arising in the shade portion 21 is thereby quickly transmitted through the metal support member 20 to the fin 22, and efficiently radiated from the fin 22.

Shade Portion Details

Figure 3A:
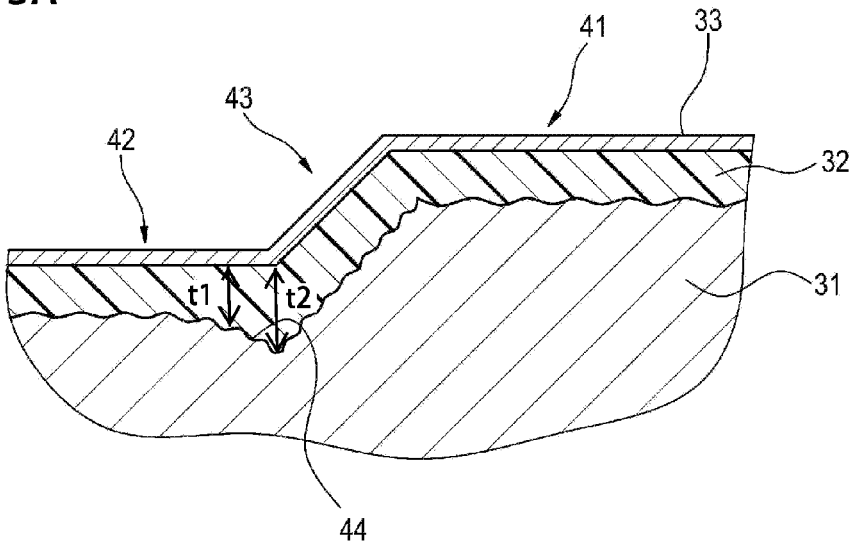
FIG. 3A is a schematic view of a shade portion of the vehicle lamp.

FIG. 3A is a schematic view of the shade portion 21 of the vehicle lamp 1 according to the embodiment, viewed from in front of the lamp. As illustrated in FIG. 3A, the shade portion 21 is formed of a metal portion 31, an undercoat layer 32 and a metal film 33.

In the embodiment, the metal portion 31 is made of aluminum. The metal portion 31 is a portion that is contiguously formed to the support member 20. The undercoat layer 32 is formed at an upper face of the metal portion 31, and the metal film 33 is formed at an upper face of the undercoat layer 32.

The thickness of the undercoat layer 32 can be set from 5 μm to 50 μm. When the thickness of the undercoat layer 32 is less than 5 μm, the surface of the metal film 33 formed at the upper face thereof may not be sufficiently smooth. When the thickness of the undercoat layer 32 is more than 50 μm, cracks may occur in the metal film 33 formed at the upper face thereof. Note that the thicknesses of the undercoat layer 32 and the metal film 33 are exaggerated in FIG. 3A.

The thickness of the metal film 33 can be set from 25 nm to 1 μm. It is difficult to evenly form the metal film 33 when the thickness of the metal film 33 is less than 25 nm. Cracks may occur in the metal film 33 when the thickness of the metal film 33 is more than 1 μm.

The support member 20 has a complex shape, including the fin 22 and various attachment portions, including an attachment portion for the semiconductor light source 11 and an attachment portion for the reflector 12. Manufacturing by casting is therefore preferable from a perspective of ease of manufacturing. However, when the support member 20 is manufactured by casting, the surface roughness thereof is liable to increase. Forming the shade portion 21 by casting is therefore unsuitable when a sharp, straight shaped light-dark boundary line is desired.

In the embodiment, therefore, firstly, the support member 20 including the metal portion 31 of the shade portion 21 is formed by casting. Minute unevenness on the metal portion 31 caused by the casting is then filled in by the resin undercoat layer 32 to give a flat upper face. The metal film 33 is then formed on the flat upper face of the undercoat layer 32 by vapor deposition, plating, or the like. The upper face of the metal film 33 is therefore flat, and the ridge line 21*a* of the shade portion 21 formed by the flat upper face of the metal film 33 is projected by the projection lens 13 to the front of the lamp, and a clear, straight shaped light-dark boundary line can be obtained.

Moreover, the surface of the shade portion 21 is made smooth by including the undercoat layer 32, such that scattering of the light reflected by the shade portion 21 can be effectively prevented, and optical use of light reflected by the shade portion 21 is facilitated. Inclusion of the undercoat layer 32 thereby enables utilization efficiency of the light to be increased, and enables occurrence of glare to be effectively prevented.

As mentioned above, it is preferable to, in this manner, form the support member 20 excluding the metal film 33 of the shade portion 21 by casting, and to form the metal film 33 by vapor deposition on the surface of the cast product with the undercoat layer 32 interposed therebetween to form the shade portion 21, for which shape precision is demanded. A support member 20, including the shade portion 21 that can form a cut-off line CL with high shape precision, can accordingly be provided at low cost.

Shade Portion Resin Pooling

As illustrated in FIG. 3A, the shade portion 21 includes a first horizontal portion 41, a second horizontal portion 42 that is positioned below the first horizontal portion 41, and an inclined portion 43 that connects the first horizontal portion 41 and the second horizontal portion 42. A downward indented recessed portion 44 is provided at an upper portion of the metal portion 31 forming a connecting portion between the second horizontal portion 42 and the inclined portion 43. A valley portion of the recessed portion 44 is positioned further downward than a horizontal portion of the metal portion 31 that forms the second horizontal portion 42. Note that the recessed portion 44 is not limited to the shape illustrated, and may be formed in a groove shape, a slit shape, or the like.

The resin forming the undercoat layer 32 (hereafter referred to as undercoating) is applied to the upper face of the metal portion 31 forming the first horizontal portion 41, the upper face of the metal portion 31 forming the second horizontal portion 42, and the upper face of the metal portion 31 forming the inclined portion 43. The undercoating applied to the upper face of the metal portion 31 forming the inclined portion 43 is liable to drip downward along the metal portion 31 forming the inclined portion 43 before curing. The undercoating is therefore liable to pool from a lower portion of the metal portion 31 forming the inclined portion 43, to the upper face of the metal portion 31 forming the second horizontal portion 42.

Figure 3B:
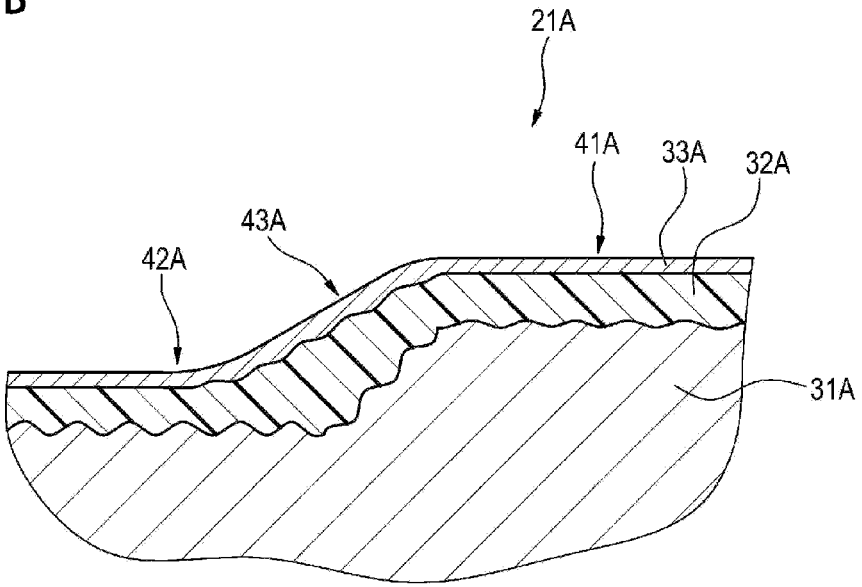
FIG. 3B is a schematic view of a shade portion of the vehicle lamp.

FIG. 3B is a similar drawing to FIG. 3A, and illustrates a shade portion 21A formed without providing a recessed portion to a metal portion 31A. As illustrated in FIG. 3B, in the shade portion 21A, the metal portion 31A forming an inclined portion 43A and the metal portion 31A forming a second horizontal portion 42A are formed following the shape of the cut-off line CL, without providing a recessed portion.

When undercoating is applied to the metal portion 31A with such a shape, the undercoating pools from the lower portion of the metal portion 31A forming the inclined portion 43A to the upper face of the metal portion 31A forming the second horizontal portion 42A before curing. As a result, the incline of the inclined portion 43A, and the start position of the inclined portion 43A from the second horizontal portion 42A deviates from the shape formed by the upper faces of the metal portion 31A. Specifically, the start angle of the inclined portion 43A decreases, and the start position of the inclined portion 43A is liable to deviate toward the left of the drawing. A shade portion 21A with the desired shaped cannot always be obtained as a result.

In the shade portion 21 of the vehicle lamp 1 according to the embodiment, as illustrated in FIG. 3A, the recessed portion 44 is provided between the metal portion 31 forming the inclined portion 43 and the metal portion 31 forming the second horizontal portion 42. Since the undercoating that drips downward before curing pools in the recessed portion 44, the upper face of the inclined portion 43 and the upper face of the second horizontal portion 42 form a shape intersecting at the desired angle as a result, and a shade portion 21 with the desired shape can be obtained.

Note that the recessed portion 44 is preferably formed so as to gradually sink deeper on progression from the second horizontal portion 42 toward the inclined portion 43. In the embodiment, as illustrated in FIG. 3A, the recessed portion 44 is formed by a flat face extending from the face of the metal portion 31 forming the inclined portion 43, and a curved face gently dropping from the metal portion 31 forming the second horizontal portion 42 on progression toward the valley portion. Namely, a distance t1 at the bottom face forming the recessed portion 44 between the bottom face at a side near the second horizontal portion 42 and the upper face of the second horizontal portion 42 is set smaller than a distance t2 at the bottom face forming the recessed portion 44 between the bottom face at a side near the inclined portion 43 and the upper face of the second horizontal portion 42.

After being applied to the metal portion 31 and before curing, the undercoating drips down along the inclined portion 43 toward the recessed portion 44 due to gravity, however the undercoating is not liable to flow from the second horizontal portion 42 toward the recessed portion 44. Namely, regarding the amount of undercoating flowing into the recessed portion 44, a large amount of undercoating flows in at the side near to the inclined portion 43, however, a large amount of undercoating is not liable to flow in at the side near to the second horizontal portion 42. A large space where the undercoating pools is therefore secured at the inclined portion 43 side of the recessed portion 44, by forming the recessed portion 44 with the above-described shape, and this is preferable in order to facilitate curing of the undercoating so as to form the upper face of the undercoat layer 32 in the desired shape.

The undercoat layer 32 is preferably formed of an ultraviolet curable resin including a photopolymerization initiator. An example of the ultraviolet curable resin is an acrylic-based ultraviolet curable resin.

In cases in which a thermoset resin is employed as the undercoating, unlike in the embodiment, the resin needs to be cured in a heat oven over a specific period of time. In the event that the resin drips down due to gravity prior to the thermoset resin curing, the shape precision of the light-dark boundary line formed by the upper face of the metal film may be reduced when the metal film is formed on top with an even film thickness.

However, the undercoating is cured straight away when illuminated with ultraviolet rays when an ultraviolet curable resin, including a photopolymerization initiator in which polymerization is initiated by ultraviolet light, is employed. The ultraviolet curable resin is therefore not liable to drip prior to curing, and the shape precision of the light-dark boundary line is not liable to be reduced.

Forming the Support Member by Combining Plural Molds

Note that, when casting the support member 20, it is preferable to combine a mold forming the shade portion 21, and a mold forming portions other than the shade portion 21.

Different shaped low beam light distribution patterns are required for a vehicle lamp destined for regions where vehicles drive on the left side of the road, and for a vehicle lamp destined for regions where vehicles drive on the right side of the road. Shade portions 21 with different respective shapes are therefore required in order to form the differently shaped low beam light distribution patterns. However, even in vehicle lamps in which the shape of the required low beam light distribution pattern is different, portions other than the shade portion 21 are common to both specifications. Low cost provision is facilitated by employing a common mold to form portions other than the shade portion 21 for plural types of vehicle lamp in which only the shape of the shade portion 21 differs.

Figure 4:
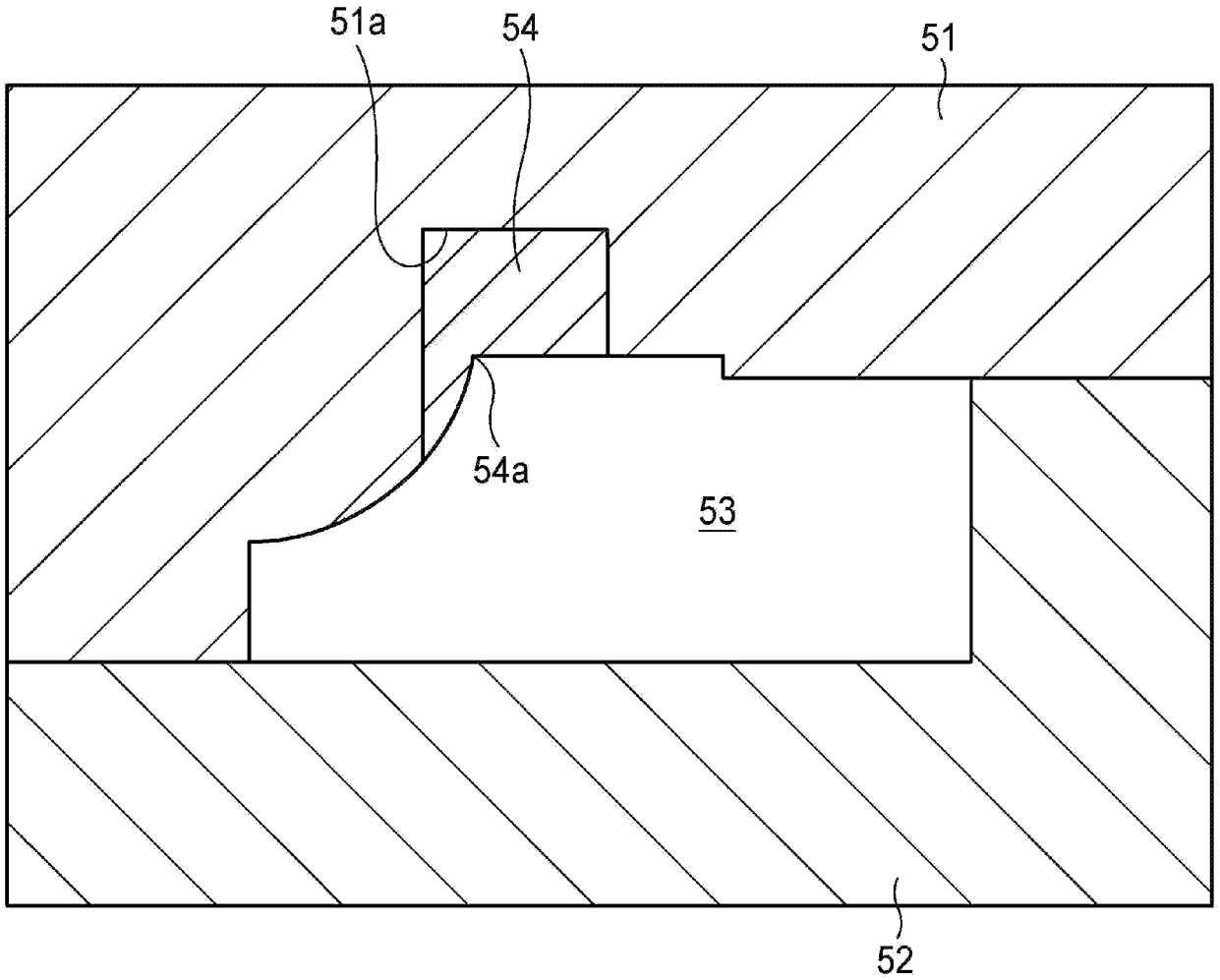
FIG. 4 is a schematic drawing illustrating placement of molds when mold forming a support member.

FIG. 4 is a schematic drawing illustrating placement of molds when mold forming the support member 20. In the embodiment, an upper mold 51 and a lower mold 52 are combined to form a cavity 53 with a shape corresponding to the support member 20. Molten metal is poured into the cavity 53 and solidified, the upper mold 51 and the lower mold 52 are then opened, and the support member 20 is removed.

In this mold, the upper mold 51 includes a mounting portion 51*a* in which an exchange mold 54 can be mounted. The exchange mold 54 includes a portion 54*a* for forming the shade portion 21. Support members 20 can be manufactured with the shade portion 21 of the desired shape by preparing plural types of exchange mold 54 with different shaped portions 54*a*, fitting the exchange molds 54 with the portion 54*a* of the desired shape into the mounting portion 51*a*, and performing mold forming.

Plural types of support member can be provided at low cost by utilizing this method, without the need to prepare plural types of the upper mold 51 itself when forming shade portions 21 that have plural different shapes.

Note that, when the exchange mold 54 forming the shade portion 21 and the upper mold 51 forming the portions other than the shade portion 21 are combined to form the support member 20 in this way, mold marks 21*b* (see FIG. 1) caused by gaps between the combined molds 51, 54 are formed to the support member 20 at the periphery of the shade portion 21. The mold marks 21*b* are protrusions, unevenness, or the like, caused by gaps between each of the molds.

Second Embodiment

Note that, although in the above-described embodiment, an example is explained in which the invention is applied to what is referred to as a vehicle lamp of PES optical system employing a reflector and a projection lens, the invention is not limited thereto. A second embodiment explained below is an example in which the invention is applied to what is referred to as a vehicle lamp of direct optical system. Members in the second embodiment that are common to the first embodiment are allocated the same reference numerals, and explanation thereof is omitted.

Figure 5:
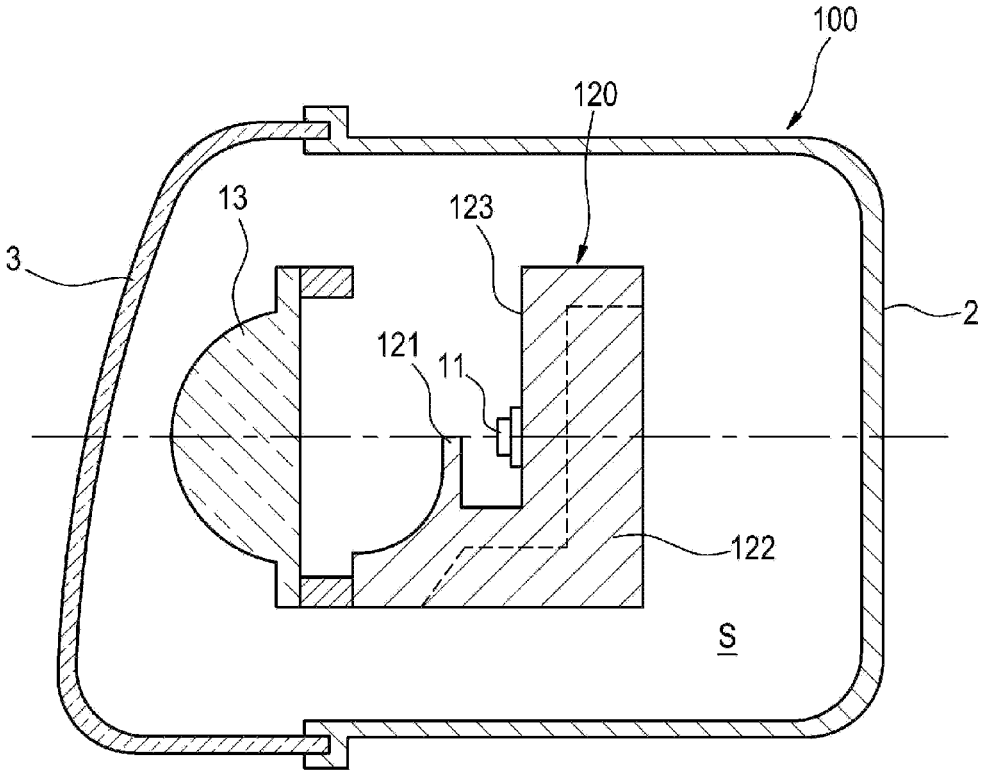
FIG. 5 is a schematic view of a vehicle lamp according to a second embodiment of the invention.

FIG. 5 is a schematic view of a vehicle lamp 100 according to the second embodiment of the invention.

As illustrated in FIG. 5, the vehicle lamp 100 according to the embodiment includes the semiconductor light source 11, the projection lens 13, and a support member 120.

The support member 120 includes a mounting face 123 facing toward the front, a shade portion 121 that is disposed further to the front than the mounting face 123, and that protrudes from a lower side toward an upper side of the lamp, and a fin 122 provided at the opposite side to the mounting face 123. The shade portion 121 and the fin 122 are integrally formed to the metal support member 120.

The semiconductor light source 11 is mounted to the mounting face 123 of the support member 120 and orientated with the light emitting face facing the front. The projection lens 13 is supported by the support member 120 at the front side of the support member 120. The projection lens 13 is disposed such that the rear side focal point thereof is positioned in the vicinity of the semiconductor light source 11.

Light emitted from the semiconductor light source 11 is emitted via the projection lens 13 to the front of the lamp. A portion of the light emitted by the semiconductor light source 11 is blocked by the shade portion 121. A light distribution pattern including a dark portion is thereby formed in front of the lamp.

Since the shade portion 121 is integrally formed to the support member 120 in the present embodiment, similarly to the above-described first embodiment, even when the shade portion 121 absorbs a large amount of heat from light emitted from the semiconductor light source 11, the heat is quickly transmitted from the shade portion 121 to other portions of the support member 120, and the shade portion 121 is not liable to become hot. Moreover, since the shade portion 121 is made of metal, it is not liable to deform, even when hot. The shape precision of the light-dark boundary line is therefore not liable to be reduced. Due to being made of metal, the shade portion 121 is also not liable to melt damage, even when sunlight is focused on the shade portion 121 by the projection lens 13.

Third Embodiment

Note that, although in the above-described first embodiment and second embodiment, examples are explained in which the invention is applied to what is referred to as a vehicle lamp of PES optical system and a vehicle lamp of direct optical system, the invention is not limited thereto. A third embodiment explained below is an example in which the invention is applied to what is referred to as a vehicle lamp of parabolic optical system. In the following explanation, members in the third embodiment that are common to the first embodiment are allocated the same reference numerals, and explanation thereof is omitted.

Figure 6:
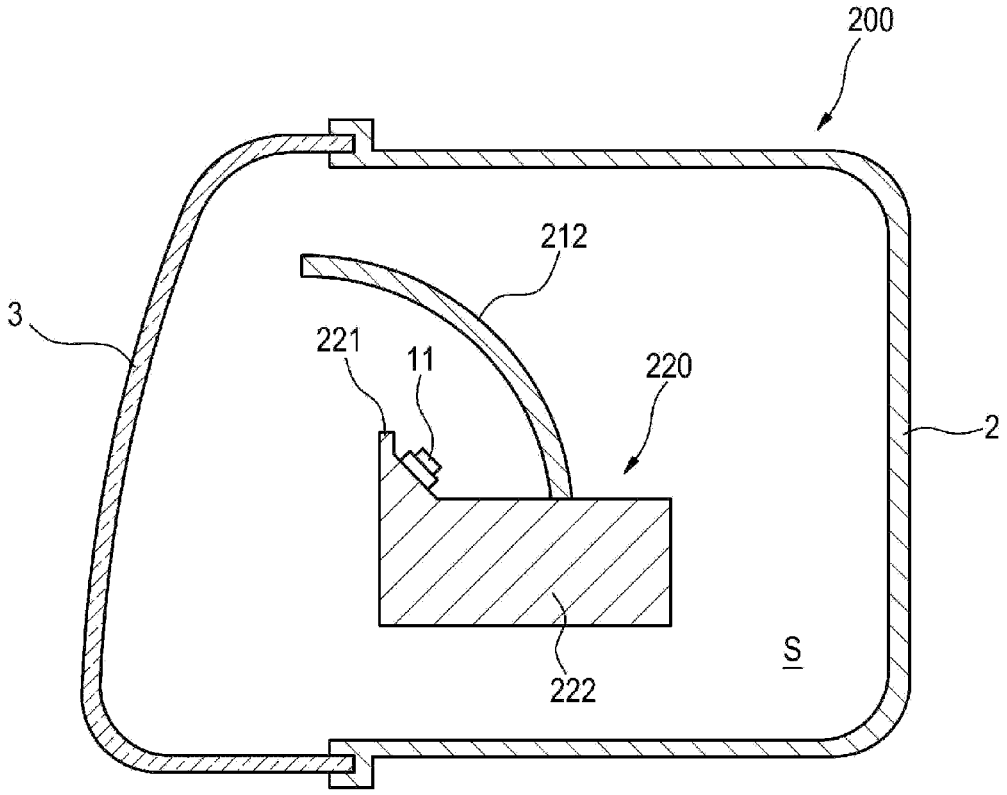
FIG. 6 is a schematic view of a vehicle lamp according to a third embodiment of the invention.

FIG. 6 is a schematic view of a vehicle lamp 200 according to the third embodiment of the invention.

As illustrated in FIG. 6, the vehicle lamp 200 according to the embodiment includes the semiconductor light source 11, a reflector 212 and a support member 220. The support member 220 is a substantially rectangular box shaped metal member.

The semiconductor light source 11 is mounted to an upper face of the support member 220, and orientated with the light emitting face thereof facing upward. The reflector 212 is attached to the upper face of the support member 220 behind the semiconductor light source 11. An inner peripheral face of the reflector 212 is a reflective face of a substantially paraboloid of revolution shape. The semiconductor light source 11 is positioned in the vicinity of the focal point of the paraboloid of revolution of the reflector 212.

In the vehicle lamp 200 of parabolic optical system, a light distribution pattern including a cut-off line is formed by the reflector 212 and a shade portion 221. The shade portion 221 blocks light, from the light emitted from the semiconductor light source 11, not heading toward the reflector 212 but instead heading directly out of the lamp.

Since the shade portion 221 is integrally formed to the support member 220 in the present embodiment, similarly to the above-described first embodiment and second embodiment, even when the shade portion 221 absorbs a large amount of heat from light emitted from the semiconductor light source 11, the heat is quickly transmitted from the shade portion 221 to other portions of the support member 220, and the shade portion 221 is not liable to become hot. Moreover, since the shade portion 221 is made of metal, it is not liable to deform, even when hot. This also suppresses light reflected by the shade portion 221 from being scattered in unintended directions.

Fourth Embodiment

Figure 7:
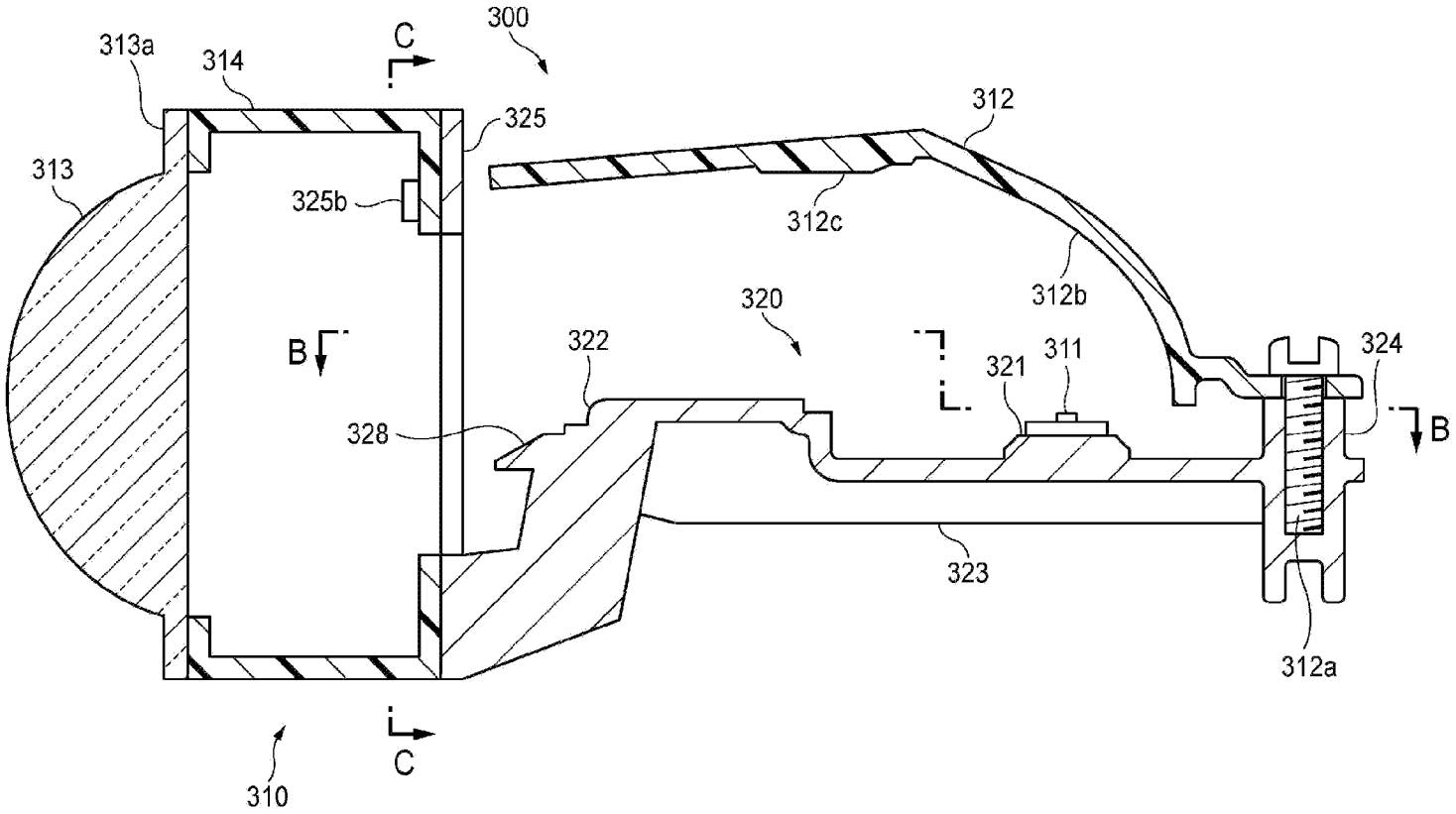
FIG. 7 is a side cross-section view of a lamp unit of a vehicle lamp according a fourth embodiment of the invention.
Figure 8:
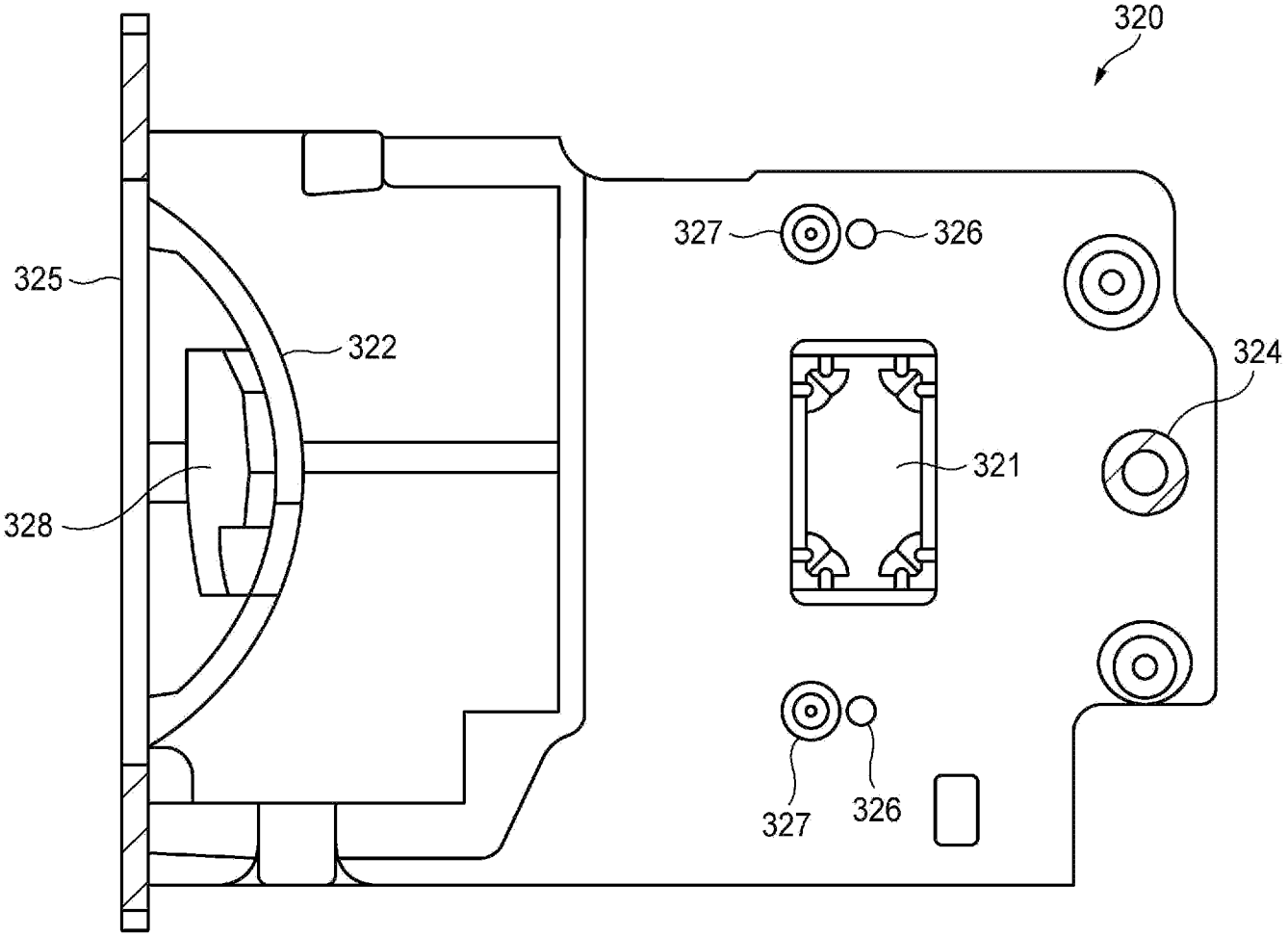
FIG. 8 is a cross-section view taken along line B-B in FIG. 7.
Figure 9:
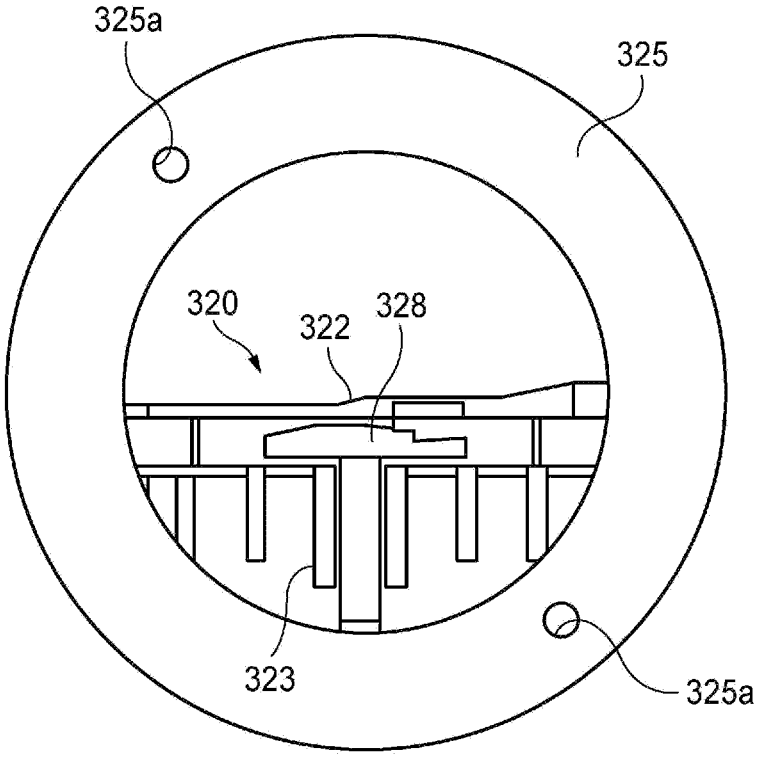
FIG. 9 is a cross-section view taken along line C-C in FIG. 7.

Explanation follows regarding a vehicle lamp 300 according to a fourth embodiment of the invention, using FIG. 7 to FIG. 13. FIG. 7 is a side cross-section view of a lamp unit 310 of a vehicle lamp 300 according the fourth embodiment. FIG. 8 is a cross-section view taken along line B-B in FIG. 7. FIG. 9 is a cross-section view taken along line C-C in FIG. 7. FIG. 8 and FIG. 9 only illustrate a support member 320.

As illustrated in FIG. 7, the lamp unit 310 includes the metal, integrally formed support member 320, a reflector 312 attached to the support member 320, a lens holder 314 attached to the support member 320, and a projection lens 313 attached to the support member 320 through the lens holder 314.

The support member 320 includes a light source attachment portion 321 to which a semiconductor light emitting device 311 is mounted, a horizontal cut line forming portion 322 (a shade portion) provided in front of the light source attachment portion 321, a heat discharge fin portion 323 provided below the light source attachment portion 321, a reflector support portion 324 provided behind the light source attachment portion 321, and a holder attachment portion 325 provided in front of the horizontal cut line forming portion 322.

The semiconductor light emitting device 311 is mounted to an upper face of the light source attachment portion 321, and orientated with a light emitting face facing upward.

The upward opening tube shaped reflector support portion 324 is provided at a rear end of the support member 320. The reflector 312 is fixed to the support member 320 by inserting a shaft portion 312*a* into the opening of the reflector support portion 324.

The reflector 312 is fixed to the reflector support portion 324 orientated so as to cover the light emitting face of the semiconductor light emitting device 311. An inner face of the reflector 312 includes a main reflective face 312*b* that is a substantially paraboloid of revolution shape, and a secondary reflective face 312*c* provided at a front portion of the main reflective face 312*b*.

The projection lens 313 is fixed to the support member 320 by the lens holder 314 fixed to a rear face thereof. A flange portion 313*a* extending in the radial direction is provided at a rear end of the projection lens 313. A rear face of the flange portion 313*a* is coupled to a front face of the lens holder 314 by welding, adhesion, or the like.

The circular plate shaped holder attachment portion 325 is integrally provided at a front end portion of the support member 320 (see FIG. 9). Screw holes 325*a*, open to the front, are provided to the holder attachment portion 325 (see FIG. 9). The lens holder 314 is fixed to the holder attachment portion 325 by fitting screws 325*b* into the screw holes 325*a* (see FIG. 7).

Electric supply attachments (not illustrated) that supply electric power to the semiconductor light emitting device 311 are mounted at an upper face of the support member 320. As illustrated in FIG. 8, electric supply attachment screw holes 326 for attaching the electric supply attachments, and positioning pins 327, are provided at an upper face of the support member 320. The positioning pins 327 project upward from the upper face of the support member 320, and position the electric supply attachments with respect to the support member 320.

In the vehicle lamp 300 of the fourth embodiment, light is focused at the horizontal cut line forming portion 322 and the periphery thereof due to the paraboloid of revolution shaped main reflective face 312*b* of the reflector 312. However, heat arising in the horizontal cut line forming portion 322 is dispersed by the support member 320 integrally provided to the horizontal cut line forming portion 322 and the heat discharge fin portion 323, preventing the horizontal cut line forming portion 322 from becoming hot.

Figure 10:
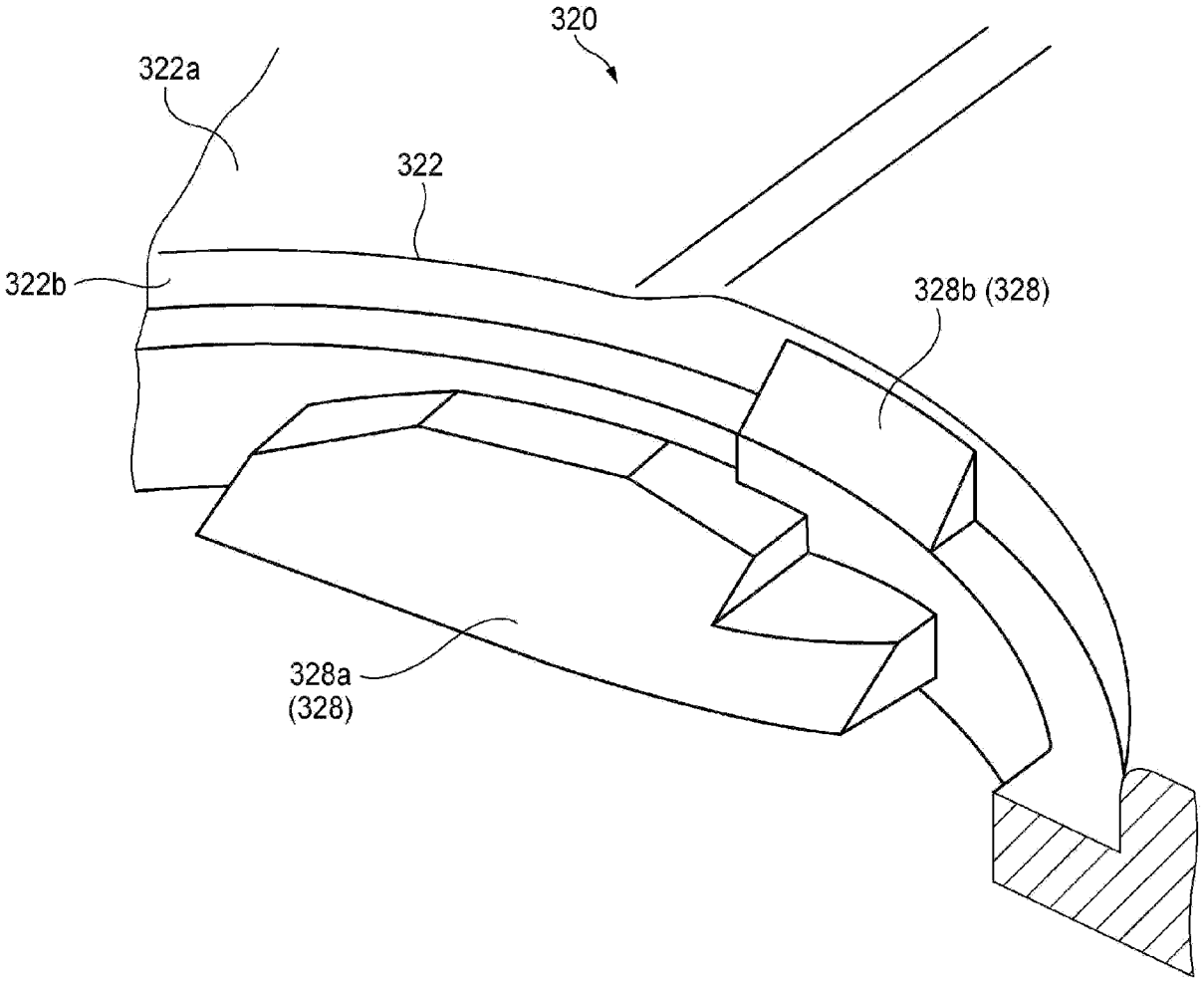
FIG. 10 is an enlarged view of a support member illustrated in FIG. 7.

FIG. 10 is an enlarged view of the periphery of the horizontal cut line forming portion 322 of the support member 320 illustrated in FIG. 7. As illustrated in FIG. 10, the horizontal cut line forming portion 322 is formed by a ridge line of the support member 320 formed by an upper face portion 322*a* facing the top of the lamp, and a front face portion 322*b* facing the front of the lamp. The upper face portion 322*a* is a flat portion positioned in front of the light source attachment portion 321. The upper face portion 322*a* is provided with a step in the left-right direction. The front face portion 322*b* is a portion contiguous to the upper face portion 322*a*, on the other side of the ridge line.

The horizontal cut line forming portion 322 is formed in a circular arc shape concave toward the rear, corresponding to a group of rear focal points of the projection lens 313. A step is also formed in the horizontal cut line forming portion 322 corresponding to the step in the upper face portion 322*a*.

As illustrated in FIG. 7, the arc shaped horizontal cut line forming portion 322 extends in a direction intersecting with the optical axis of the vehicle lamp 300, which faces along the front-rear direction. When viewed in a cross-section orthogonal to the extension direction of the horizontal cut line forming portion 322, the ridge line, formed from the upward-facing upper face portion 322*a* of a metal portion of the horizontal cut line forming portion 322 to the front-facing front end portion 322*b*, is formed in a rounded shape with a radius of curvature from 0.1 mm to 1.0 mm. Note that, as explained in the first embodiment, an undercoat layer and metal film, etc., may be provided to the surface of the metal portion of the horizontal cut line forming portion 322.

An OHS forming portion 328 is provided below the horizontal cut line forming portion 322. The OHS forming portion 328 forms an Over Head Sign (OHS) light distribution pattern in order to facilitate recognition of signs.

The OHS forming portion 328 includes a first reflective face 328*a* and a second reflective face 328*b*. The first reflective face 328*a* is a larger reflective face than the second reflective face 328*b*. The first reflective face 328*a* and the second reflective face 328*b* are provided in front of and below the horizontal cut line forming portion 322. The first reflective face 328*a* is provided below the second reflective face 328*b*. The first reflective face 328*a* is provided in front of the second reflective face 328*b*. Viewed from its front face, the second reflective face 328*b* is provided at a position offset further to one side than a center line passing through the semiconductor light emitting device 311. In the example illustrated, the second reflective face 328*b* is provided in a position offset to the right.

Figure 11:
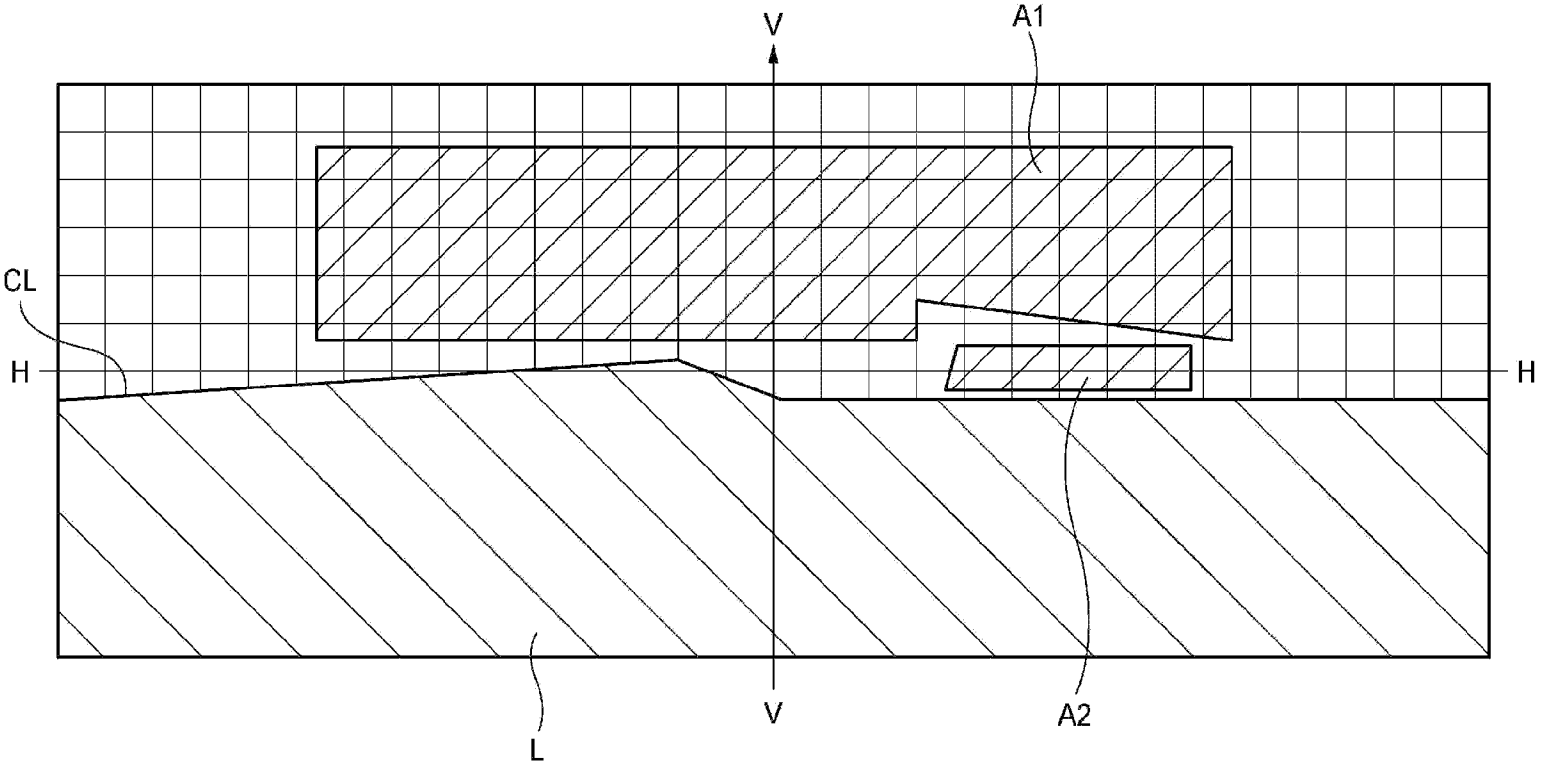
FIG. 11 is a view illustrating a light distribution pattern formed by the vehicle lamp of the fourth embodiment of the invention.

FIG. 11 illustrates a light distribution pattern formed by the vehicle lamp 300. FIG. 11 is a view of a virtual screen disposed vertically at a point 25*m* in front of the vehicle lamp 300, viewed from the lamp side.

Light emitted from the semiconductor light emitting device 311, and reflected by the main reflective face 312*b* of the reflector 312 is incident to the projection lens 313, while a portion of the light is blocked by the horizontal cut line forming portion 322. The projection lens 313 illuminates the light toward the front of the lamp to form a low beam light distribution pattern L.

Light emitted from the semiconductor light emitting device 311 and reflected by the secondary reflective face 312*c* of the reflector 312 is incident to the first reflective face 328*a* and the second reflective face 328*b*. The first reflective face 328*a* and the second reflective face 328*b* reflect the light toward the projection lens 313. The projection lens 313 illuminates the light toward the front of the lamp to form the OHS light distribution pattern.

The OHS forming portion 328 illuminates light above a horizon line in front of the vehicle to form the OHS light distribution pattern.

In the embodiment, the first reflective face 328*a* illuminates light to a first region A1 from 2° to 4° above the horizon line, and the second reflective face 328*b* illuminates light to a second region A2 above the horizon line.

Note that, although in the embodiment, an example is explained in which the first reflective face 328*a* and the second reflective face 328*b* are provided at a separation to each other, the first reflective face 328*a* and the second reflective face 328*b* may also be formed contiguously to each other.

Figure 12:
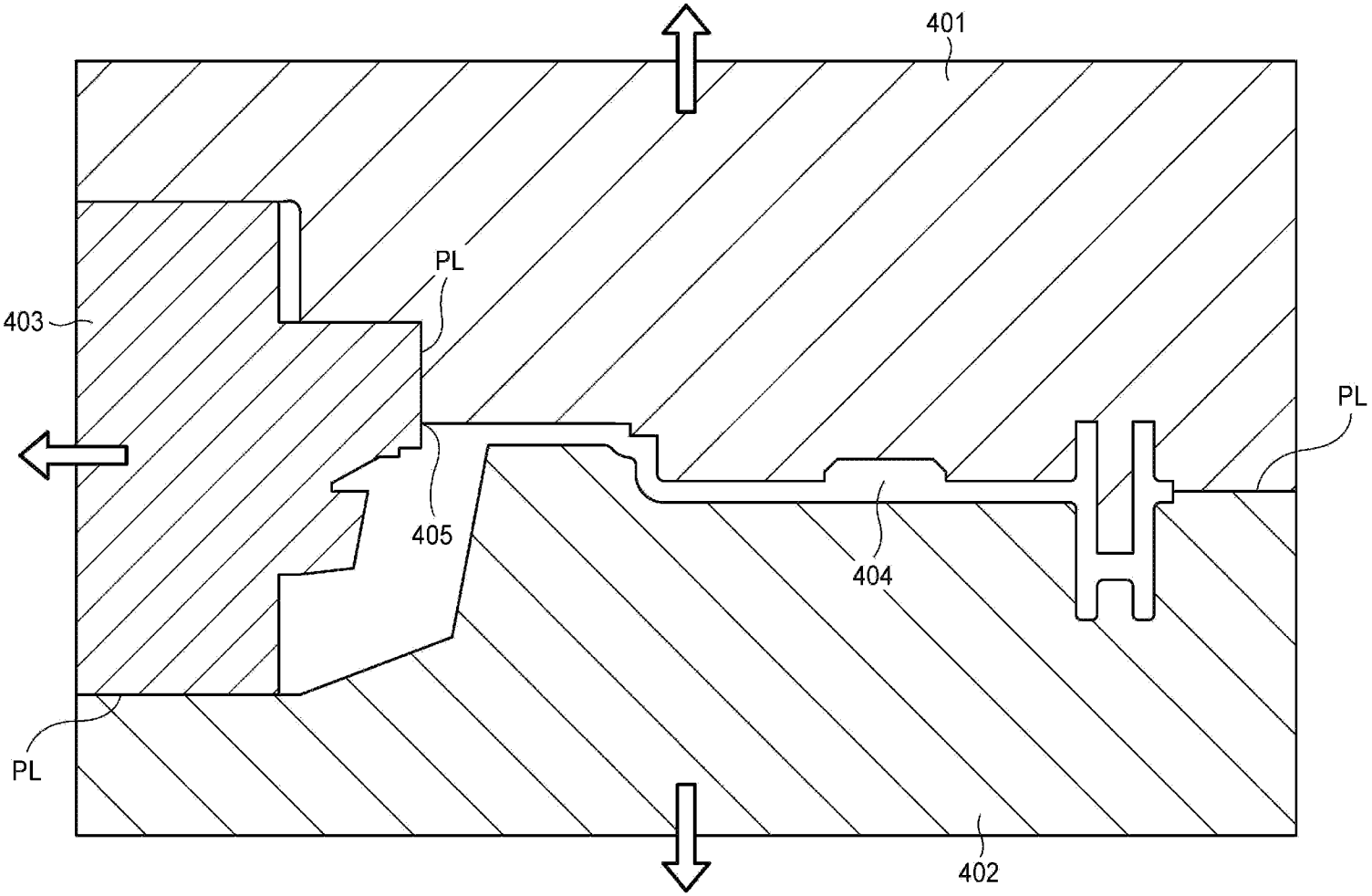
FIG. 12 is a layout diagram of a mold illustrating a manufacturing method according to a reference example.
Figure 13:
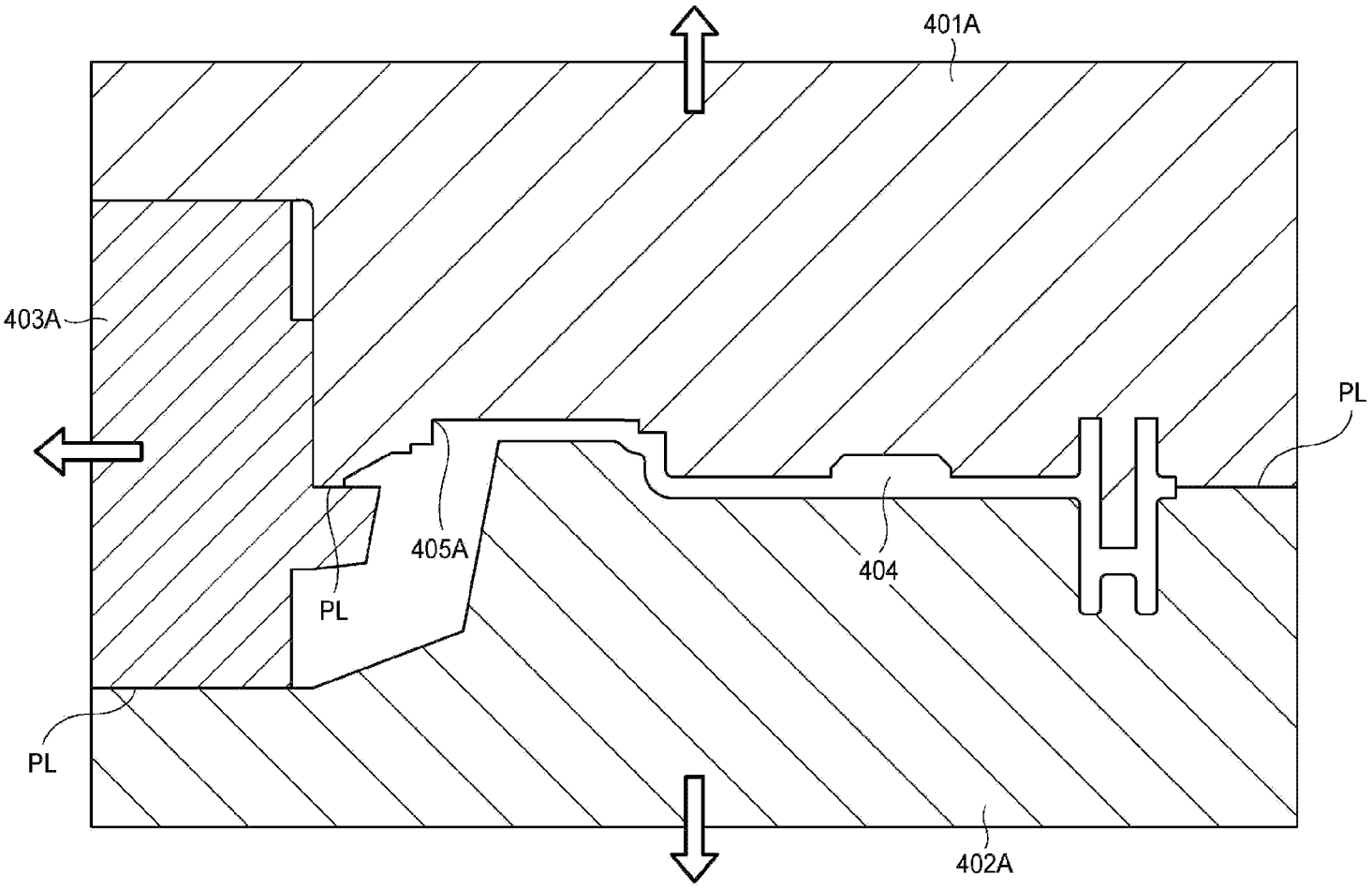
FIG. 13 is a layout diagram of a mold according to the preferred manufacturing method.

Explanation follows regarding a preferred manufacturing method of the support member 320 according to the fourth embodiment, and in particular a molding method of the support member 320 utilizing a mold, with reference to FIG. 12 and FIG. 13. FIG. 12 is a layout diagram of a mold illustrating a manufacturing method according to a reference example. FIG. 13 is a layout diagram of a mold according to the preferred manufacturing method.

Complex shapes such as the support member 320 of the embodiment can be manufactured, for example, by mold forming employing three molds. As illustrated in FIG. 12 and FIG. 13, an upper mold 401 capable of up-down movement, a lower mold 402 capable of up-down movement, and a front mold 403 capable of front-rear movement are prepared so as to form a cavity 404, that forms the shape of the support member 320.

Molten metal is poured into the cavity 404, the metal is cooled and solidified, the molds are opened, and the support member 320 integrally formed to the horizontal cut line forming portion 322 is removed. The support member 320 can be manufactured in this manner.

Alternatively, a mixture of a metal powder and resin can be injected into the cavity 404 and heated to drive off the resin component to solidify a metal support member 320, and then the molds are opened to remove the support member 320 integrally formed to the horizontal cut line forming portion 322 (metal powder injection molding).

However, as illustrated in FIG. 13, when forming the cavity 404 using plural molds, it is preferable to position a parting line PL of the molds at a different position to a cut line transfer portion 405 that forms the horizontal cut line forming portion 322. When the parting line PL is positioned at the cut line transfer portion 405, as illustrated in FIG. 12, burr is liable to occur at the horizontal cut line forming portion 322 thereby obtained. Processing to remove this burr reduces production efficiency.

It is generally considered to be easier to form a clear horizontal cut line during light distribution when the horizontal cut line forming portion 322 is formed with a sharp profile. Thus it might be considered that, when designing a mold to obtain a shade portion, a mold parting line should be positioned at the shade portion, as illustrated in FIG. 12.

However, when integrally molding the support member 320 including the horizontal cut line forming portion 322 from metal as in the present embodiment, molten metal or resin containing metal powder is liable to enter gaps between the molds. In the support member 320 obtained using the mold in FIG. 12, therefore, molten metal or resin containing metal powder enters the parting line PL, and a burr is formed at the horizontal cut line forming portion 322. A need therefore arises to machine the burr occurring at the horizontal cut line forming portion 322, and perform finishing polishing of the machined portion. The inventor has thus observed that productivity is affected by the position in which the parting line PL of the mold is provided when integrally forming the support member 320 including the horizontal cut line forming portion 322, as in the embodiment.

As illustrated in FIG. 13, therefore, the horizontal cut line forming portion 322 is preferably formed by transferring a cut line transfer portion 405A with a shape corresponding to the horizontal cut line forming portion 322 formed by a single mold. In the embodiment, the horizontal cut line transfer portion 405A is formed in an upper mold 401A. Namely, the upper mold 401A, a lower mold 402A and a front mold 403A are disposed such that the mold parting line PL is not positioned at the horizontal cut line forming portion 322.

There is no occurrence of burr at the horizontal cut line forming portion 322 in the manufacturing method employing such a mold. Moreover, in the example in FIG. 13, the parting line PL of the upper mold 401A and the lower mold 402A is positioned in a region that does not contribute to the light distribution. There is accordingly no adverse impact on the light distribution pattern, even when burr is not removed.

In particular, in the embodiment, the horizontal cut line transfer portion 405A is formed by carving with a blade to give a radius of curvature from 0.1 mm to 1.0 mm. When transferring the shape of a mold, it is easier to stably transfer rounded shapes than to transfer sharply pointed shapes. The horizontal cut line forming portion 322 formed by transferring the shape of the horizontal cut line transfer portion 405A therefore has a rounded shape with a radius of curvature of from 0.1 mm to 1.0 mm, and can be manufactured without variation in shape precision.

Note that, although a vehicle lamp that forms a low beam light distribution pattern is explained in the above-described first embodiment to fourth embodiment, the invention is not limited thereto. The invention may also be applied to a cornering light, a fog light, an overhead sign light for vehicles, or the like, that form a light distribution pattern including a dark portion.

What is claimed is:

1. A vehicle lamp comprising:

a light source including a semiconductor light emitting device; and a support member, formed of metal, on which the light source is mounted, wherein the support member is integrally formed with a shade portion, formed primarily of metal, configured to block a portion of light emitted from the semiconductor light emitting device, the shade portion includes a metal portion contiguous to the support member, the shade portion extends in a direction intersecting with an optical axis of the vehicle lamp, wherein the shade portion further includes:

a first horizontal portion;

a second horizontal portion positioned below the first horizontal portion; and an inclined portion which connects together the first horizontal portion and the second horizontal portion, and a line forming portion, formed from an upward-facing upper face portion of the metal portion of the shade portion to a front-facing front face portion of the metal portion, is formed in a rounded shape with a radius of curvature of from 0.1 mm to 1.0 mm in a cross-section orthogonal to the shade portion extension direction.

2. The vehicle lamp according to claim 1, wherein:

the shade portion includes an undercoat layer formed on the metal portion, and a metal film formed on the undercoat layer.

3. The vehicle lamp according to claim 2, wherein:

the shade portion includes:

an upper portion of the metal portion forming a connecting portion between the inclined portion and the second horizontal portion includes a recessed portion indented downward.

4. The vehicle lamp according to claim 3, wherein the undercoat layer is an ultraviolet curable resin including a photopolymerization initiator.

5. The vehicle lamp according to claim 2, wherein the undercoat layer is an ultraviolet curable resin including a photopolymerization initiator.

6. The vehicle lamp according to claim 1, wherein at least one protrusion formed during a molding process extends from the support member at the periphery of the shade portion.

7. A method of manufacturing the metal support member of the vehicle lamp of claim 1, comprising:

preparing a plurality of molds so as to form a cavity forming the shape of the support member; and introducing metal into the cavity and solidifying the metal, and removing the shade portion integrally formed to the support member, wherein the plurality of molds are disposed such that at a parting line of the molds is not positioned at the shade portion.

8. The manufacturing method according to claim 7, wherein the molds include a round shaped portion with a radius of curvature of from 0.1 mm to 1.0 mm, and the shape of the round shaped portion is transferred to form the shade portion.

* * * * *